US007568520B2

(12) United States Patent
Ozawa et al.

(10) Patent No.: US 7,568,520 B2
(45) Date of Patent: Aug. 4, 2009

(54) OIL COOLER

(75) Inventors: Tatsuhiro Ozawa, Tokyo (JP); Shiro Nakajima, Tokyo (JP); Norimitsu Matsudaira, Tokyo (JP); Takahiro Nakakomi, Tokyo (JP); Shinichi Miyasaka, Tokyo (JP); Hisashi Onuki, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 123 days.

(21) Appl. No.: 11/471,735

(22) Filed: Jun. 21, 2006

(65) Prior Publication Data

US 2007/0000639 A1 Jan. 4, 2007

(30) Foreign Application Priority Data

Jun. 21, 2005 (JP) ..... 2005-180173
Jun. 21, 2005 (JP) ..... 2005-180174

(51) Int. Cl.
*F28F 9/16* (2006.01)

(52) U.S. Cl. ..... 165/178; 165/79; 165/140; 165/167; 165/916; 138/89; 285/203

(58) Field of Classification Search ..... 165/79, 165/140, 148, 153, 178, 916; 285/139.3, 285/202, 203; 138/89
See application file for complete search history.

(56) References Cited

U.S. PATENT DOCUMENTS 4,094,358 A 6/1978 Neveux
4,227,570 A * 10/1980 Crews ..... 165/140
4,519,449 A * 5/1985 Hoskins et al. ..... 285/140.1
4,538,679 A * 9/1985 Hoskins et al. ..... 165/178
4,846,268 A * 7/1989 Beldam et al. ..... 165/153
5,121,790 A * 6/1992 Persson ..... 165/140
5,151,157 A * 9/1992 Le Gauyer ..... 165/140
6,016,865 A * 1/2000 Blomgren ..... 165/148
6,082,449 A * 7/2000 Yamaguchi et al. ..... 165/167
6,289,979 B1 * 9/2001 Kato ..... 138/89
6,988,541 B2 * 1/2006 Nakajima et al. ..... 165/140
7,188,664 B2 * 3/2007 Fuller et al. ..... 165/140
7,260,893 B2 * 8/2007 Calhoun et al. ..... 165/178
2005/0173101 A1 * 8/2005 Ohno ..... 165/153
2006/0278378 A1 * 12/2006 Okura et al. ..... 165/140

FOREIGN PATENT DOCUMENTS

EP 0 866 300 A2 9/1998
FR 2 306 421 A1 10/1976
JP 3245739 B2 4/1999
JP 11-211379 A 8/1999
JP 2001-272195 A 10/2001
JP 2002-195783 A 7/2002
JP 2003-314761 A 11/2003

* cited by examiner

*Primary Examiner*—Leonard R Leo
(74) *Attorney, Agent, or Firm*—Foley & Lardner LLP

(57) ABSTRACT

An oil cooler is contained in a radiator tank. It includes a connecting pipe having an enlarged diameter portion, a heat exchange part including elements and a communicating passage fluidically communicating the elements, and a pipe connector. The pipe connector has a first retaining portion seated on one side of a wall portion of the radiator tank to contain and fix at least a part of the enlarged diameter portion of the connecting pipe by caulking, and a second retaining portion inserted through a through-hole of the wall portion and an one end portion of the communicating passage to fix the heat exchanger part and the wall portion at the other side of the wall portion by caulking.

13 Claims, 16 Drawing Sheets

PRIOR ART

PRIOR ART

OIL COOLER

BACKGROUND OF THE INVENTION

1. Field of the Invention

The present invention relates to an oil cooler that is contained in a radiator tank and used for a motor vehicle or the like.

2. Description of the Related Art

A conventional oil cooler contained in a radiator tank is disclosed in Japanese patents laying-open publication No. 2001-272195, No. 2002-195783, and No. (Tokkaihei) 11-211378, and Japanese Patent No. 3245739. The oil cooler is provided with a heat exchange part for cooling oil flowing therethrough, two connecting pipes each for connecting a top portion of a communicating passage of the heat exchange part and a vehicle-side device, and two patch plates each for fluidically plugging a bottom portion of the communicating passage.

The heat exchange part includes a plurality of elements, each of which has coupled shell members containing an inner fin and are piled up. The two communicating passages are formed vertically at the both side portions of the elements so as to fluidically communicate interior portions of the elements with each other.

The top portions of the communicating passages are fluidically connected with the connecting pipes, respectively, by using a cylindrical pipe connector which is inserted into a pipe connecting hole formed on the radiator tank. In general, the connecting pipes are screwed together with the pipe connecters with a seal member arranged therebetween.

This conventional oil cooler, however, encounters the following problems in production management, causing high manufacturing costs and others. Specifically, it takes some trouble with tightening torque management when screwing a nut to the pipe connecter to fix the connecting pipe, and seal-member extrusion-or-intrusion preventing management. In addition, various diameter types of pipe connectors are required so as to fit different diameters of the connecting pipes, which increases its design and manufacturing costs. Further, the heat exchange part and the radiator tank are fixed with each other by using an additional member, which also increases the number of parts and increases the manufacturing costs because of necessity for high accurate temporary assembly of the pipe connectors, the heat exchange part, and the radiator tank in order to avoid bad brazing and oil leak.

On the other hand, the bottom portions of the communicating passages are plugged by using the patch plates. FIGS. 20 and 21 show different conventional examples using the patch plates.

Referring to FIG. 20, an oil cooler is fixed at its top portion with a connecting pipe 02, and provided with a plurality of elements 05 and 05*b*, in which the undermost element 05*b* has the same construction as those of the other elements 05. In order to fluidically plug a communicating passage RO, a patch plate 013 is fixed by brazing to a lower shell member 07 of the undermost element 05*b* with a seat member S arranged therebetween.

Referring to FIG. 21, another oil cooler is fixed at its top portion with a connecting pipe 02, and provided with a plurality of elements 05 and 05*b*, in which the undermost element 05*b* has a lower shell member 07 in a shape different from those of the other elements 05; In order to fluidically plug a communicating passage RO, a patch plate 013 is fixed by brazing to the lower shell member 07 without such a seat member shown in FIG. 20.

However, the oil cooler of the former requires the seat member S in order to firmly fix the patch plate 013 to the undermost element 05*b* by brazing, which increases the number of parts and its manufacturing process and costs. The oil cooler of the latter requires different shaped elements, increasing the number of parts and its manufacturing process and costs.

It is, therefore, an object of the present invention to provide an oil cooler which overcomes the foregoing drawbacks and can decrease the number of parts and its manufacturing process and costs.

SUMMARY OF THE INVENTION

According to a first aspect of the present invention there is provided an oil cooler contained in a radiator tank, the oil cooler including a connecting pipe having an enlarged diameter portion, a heat exchange part having a plurality of elements which are piled up and flow oil through interior portions thereof, and a pipe connector. The elements are formed with a communicating passage for fluidically communicating with the interior portions of the elements. The pipe connector formed with a first retaining portion that is seated on one side of a wall portion of the radiator tank to contain and fix at least a part of the enlarged diameter portion of the connecting pipe, and a second retaining portion that is inserted through a through-hole of the wall portion and an one end portion of the communicating passage to fix the heat exchange part and the wall portion at the other side of the wall portion. The elements include an upper shell member having a cylindrical portion projecting outwardly and a lower shell member having a cylindrical portion projecting outwardly and having an outer diameter smaller than an inner diameter of the cylindrical portion of the upper shell member, the cylindrical portion of the lower shell member is fixed to the cylindrical portion of the upper shell portion of an adjacent element thereof to form the communicating passage by the cylindrical portions of the upper and lower shell members. Preferably, the communicating passage is fluidically plugged at the other end portion thereof by a patch plate having a seat portion directly contactable to an outer surface of the lower shell member, a cylindrical portion for fixing the lower shell member of an outermost element, and an annular groove formed between the seat portion and the cylindrical portion to receive the cylindrical portion of the lower shell member of the outermost element. The cylindrical portion of the lower shell member of the outermost element is clamped by a radially outwardly bent portion of the cylindrical portion and a bottom portion of the annular groove.

Therefore, the number of parts of the oil cooler and its manufacturing costs can be decreased. The heat exchange part can be manufactured at low costs. The other end portion of the communicating passage can be easily and surely plugged, and all the elements can be set to have the same shapes and constructions, decreasing the manufacturing process and costs.

Preferably, the first retaining portion is a large-diameter cylindrical portion having notches, and the second retaining portion is a small-diameter cylindrical portion.

Therefore, the pipe connector can be easily formed and caulked.

Preferably, the small-diameter cylindrical portion is formed smaller in thickness than the large-diameter cylindrical portion.

Therefore, the through-hole of the wall portion can be set small in diameter, ensuring a high stiffness of the wall portion.

Preferably, the cylindrical portion of the patch plate is formed to have a thickness that becomes smaller with a height thereof.

Therefore, the cylindrical portion of the patch plate can be easily caulked.

According to a first aspect of the present invention there is provided an oil cooler contained in a radiator tank, the oil cooler including a connecting pipe having an enlarged diameter portion, a heat exchange part, and a patch plate. The heat exchange part has a plurality of elements which are piled up and flow oil through interior portions thereof, the elements being formed with a communicating passage for fluidically communicating with the interior portions of the elements, and the elements including an upper shell member having a cylindrical portion projecting outwardly and a lower shell member having a cylindrical portion projecting outwardly and having an outer diameter smaller than an inner diameter of the cylindrical portion of the upper shell member, the cylindrical portion of the lower shell member is fixed to the cylindrical portion of the upper shell portion of an adjacent element thereof to form the communicating passage by the cylindrical portions of the upper and lower shell members. The patch plate has a seat portion directly contactable to an outer surface of the lower shell member, a cylindrical portion for fixing the lower shell member, of an outermost element, and an annular groove formed between the seat portion and the cylindrical portion to receive the cylindrical portion of the lower shell member of the outermost element so as to fluidically plug an end portion of the communicating passage. The cylindrical portion of the lower shell member of the outermost element is clamped by a radially outwardly bent portion of the cylindrical portion and a bottom portion of the annular groove.

Therefore, the end portion of the communicating passage can be easily plugged by the patch plate, using the same shaped elements. This can decrease its manufacturing process and costs.

Preferably, all parts of the oil cooler and the wall portion of the radiator tank are made of aluminum and brazed.

Therefore, its manufacturing process and costs can be decreased.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Figure 1:
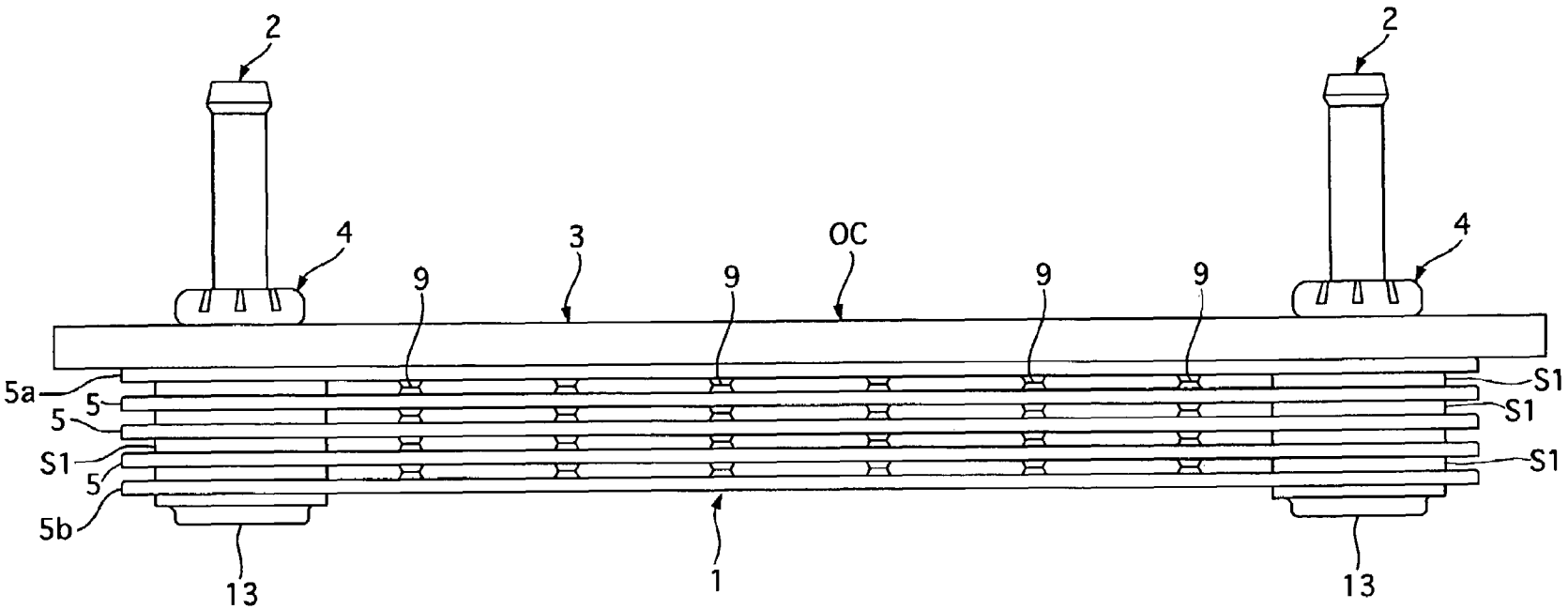
FIG. 1 is a front view showing an entire construction of an oil cooler of an embodiment according to the present invention.

Throughout the following detailed description, similar reference characters and numbers refer to similar elements in all figures of the drawings, and their descriptions are omitted for eliminating duplication.

Figure 2:
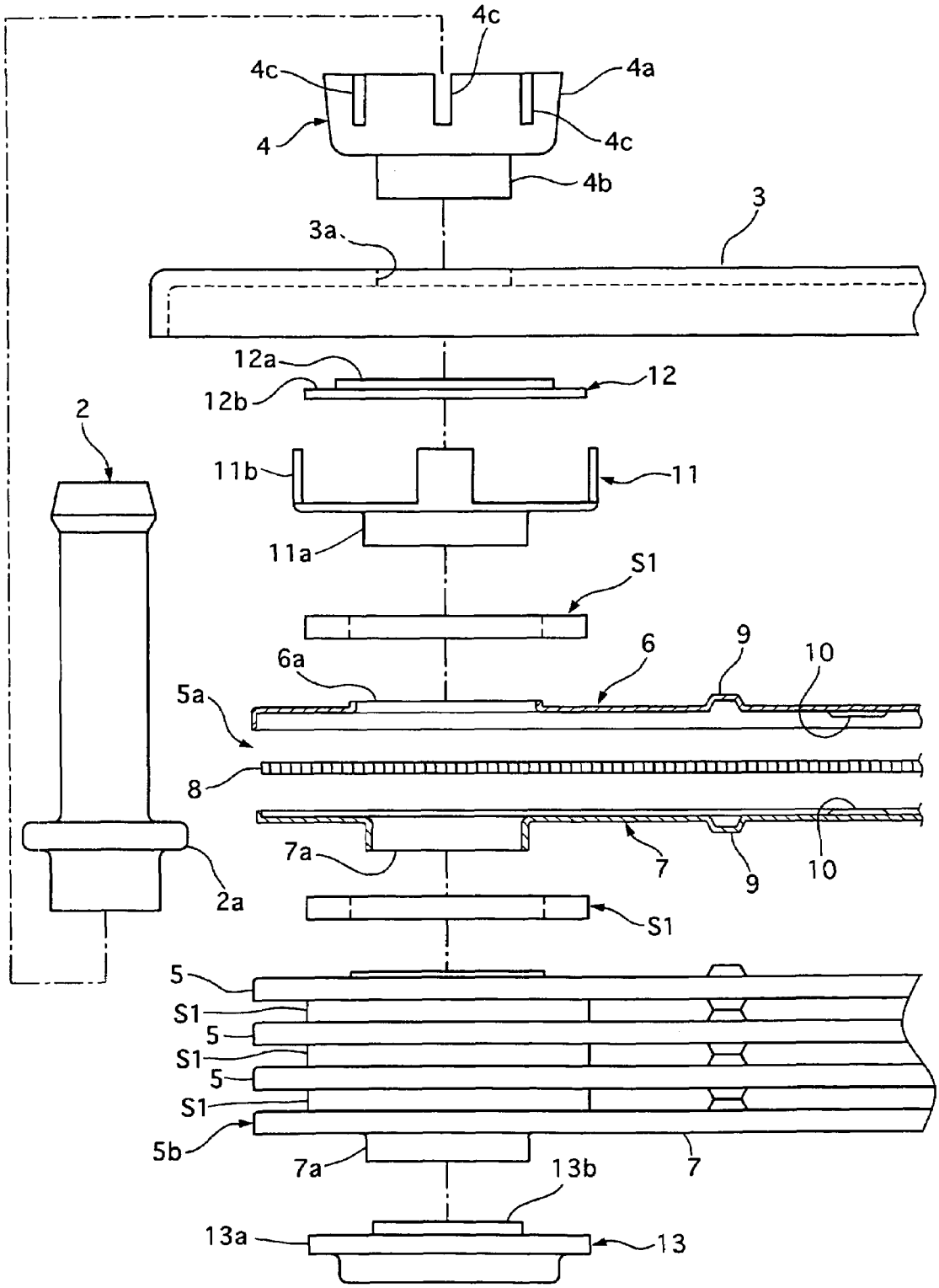
FIG. 2 is an exploded and enlarged front partial view of the oil cooler shown in FIG. 1.
Figure 3:
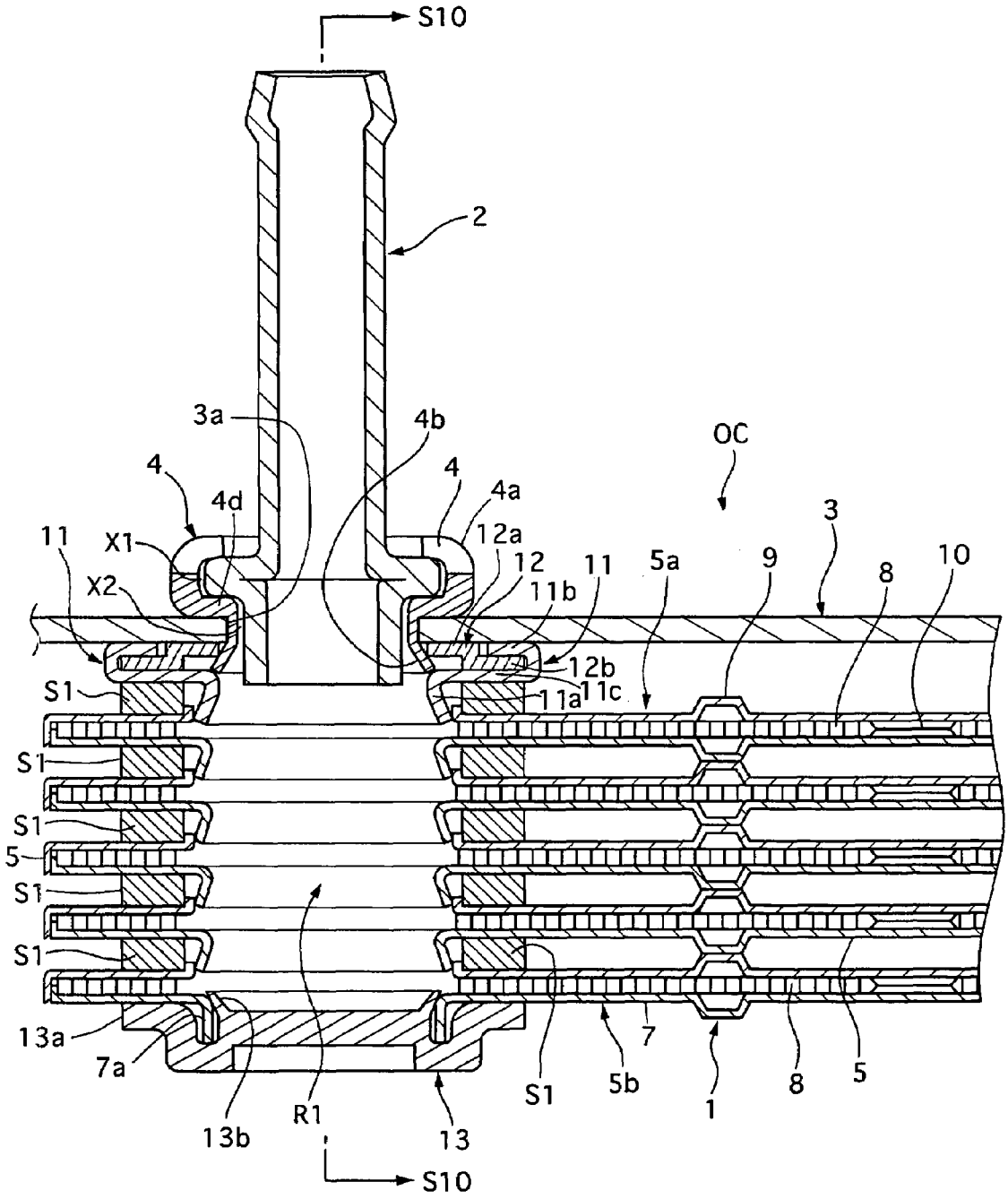
FIG. 3 is a front sectional view of the oil cooler, shown in FIG. 1, which is assembled from a state shown in FIG. 2.

Referring to FIGS. 1 to 3, there is shown an oil cooler OC of an embodiment according to the present invention. FIGS. 2 and 3 is sectional front views showing only a left part of the oil cooler OC, and its left and right parts are symmetrical with respect to each other.

The oil cooler OC is used for cooling oil of an automatic transmission mounted on a motor vehicle for example, and arranged in a lower radiator tank of a not-shown radiator, so that radiator coolant flows around the oil cooler OC to draw heat from the oil after the radiator coolant is cooled by a radiator core of the radiator.

The oil cooler OC includes a heat exchange part 1 having a plurality of elements 5*a*, 5 and 5*b* fluidically connected by left and right communicating passages R1 formed at their left and right portions, two connecting pipes 2 each for connecting a top portion of the communicating passage R1 and a vehicle-side device, and two patch plates 13 and 13 each for fluidically plugging a bottom portion of the communicating passages R1.

The heat exchange part 1 has the five elements, consisting of an uppermost element 5*a*, three intermediate elements 5 and an undermost element 5*b*, and annular seat members S1 each arranged between the adjacent elements 5*a* and 5, 5 and 5 and 5 and 5*b*. Specifically, the elements 5*a*, 5 and 5*b* and the seat members S1 are alternatively piled up so that the coolant can pass through gaps formed between the adjacent elements 5*a* and 5, 5 and 5, and 5 and 5*b* so as to exchange heat between the oil and the radiator coolant.

The elements 5*a*, 5 and 5*b* have each an upper shell member 6 and a lower shell member 7 which are coupled with each other to contain an inner fin 8.

As shown in FIG. 2, the upper shell member 6 is formed with a left cylindrical portion 6*a* projecting outwardly in an upside direction at its left end portion, and the lower shell member 7 is formed with a left cylindrical portion 7*a* projecting outwardly in a downside direction at its left end portion. An inner diameter of the left cylindrical portion 6*a* of the upper shell member 6 is set larger than an outer diameter of the left cylindrical portion 7*a* of the lower shell member 7, so that the latter can be inserted into the former and fixed thereto by caulking the former. The left cylindrical portions 6*a* and 7*a* of the upper and lower shell members 6 and 7 form a left communicating passage RI extending vertically and fluidically communicating interior portions of the elements 5*a*, 5 and 5*b* with each other as shown in FIG. 3. The left and right cylindrical portions 6*a* of the upper shell members 6 are inserted into the seat members S1 in order to keep a space between the adjacent elements 5*a* and 5, 5 and 5, and 5 and 5*b*.

A right communicating passage is formed at the right end portions of the elements 5*a*, 5 and 5*b* by right cylindrical portions of the upper and lower shell members 6 and 7 similarly to and in symmetrical with respect to the left communicating passage R1, although they are not shown in the accompanying drawings. The left and right communicating passage R1 correspond to a communicating passage of the present invention. Between the left and right communicating passages R1, the upper and lower shell members 6 and 7 are provided with a plurality of protrusions 9 projecting in the upside and downside directions, respectively, along their longitudinal direction. The protrusions 9 of the adjacent upper and lower shell members 6 and 7 are contactable with each other to have a total vertical height having the same thickness as that of the seat member S1 so as to keep the space between the adjacent elements 5*a* and 5, 5 and 5, and 5 and 5*b*.

The upper and lower shell members 6 and 7 are also provided with a plurality of dimpled grooves 10 on their inner surfaces along the longitudinal direction in order to suppress deformation of the elements 5*a*, 5 and 5*b* in a brazing process of the oil cooler OC.

Figure 4:
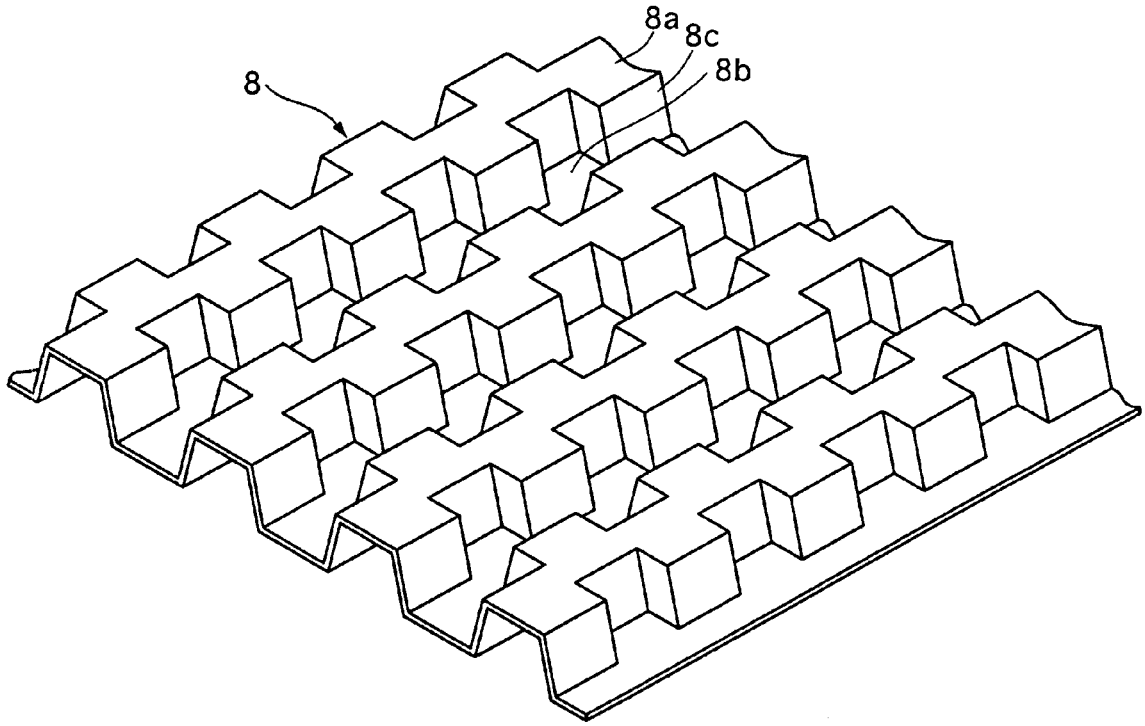
FIG. 4 is an enlarged perspective view showing an inner fin used in the oil cooler shown in FIGS. 1 to 3.

As shown in FIG. 4, the inner fin 8 is formed to have a plurality of lines of top portions 8*a* and bottom portions 8*b*, and side wall portions 8*c* connecting the top portions 8*a* and the bottom portions 8*c* so that their boxy fragment portions are dislocated alternatively in its lateral direction to form an offset fin. This enables the oil to flow like in zigzags along lower longitudinal passages formed by the side wall portions 8*c*, the top portions 8*a* and the lower shell member 7, and upper longitudinal passages formed by the side wall portions 8*c*, the bottom portions 8*b* and the upper shell member 6 so as to improve heat transfer efficiency. The inner fin 8 is not limited to the offset fin shown in this embodiment, and another kind of inner fin may be used, including a non-offset inner fin.

On the uppermost element 5*a*, the connecting pipes 2 and an top wall portion 3 of the lower radiator tank are fixed by using a connecting member 11, a seat plate 12 and a pipe connector 4 so that the connecting pipes 2 can be fluidically communicated with the top portions of the left and right communicating passages R1, respectively. The top wall portion 3 corresponds to a wall portion of the present invention, and the lower radiator tank corresponds to a radiator tank of the present invention.

On the other hand, on the lowermost element 5*b*, the patch plates 13 are fixed to fluidically plug the bottom portions of the left and right communicating passages R1, respectively.

Figure 5:
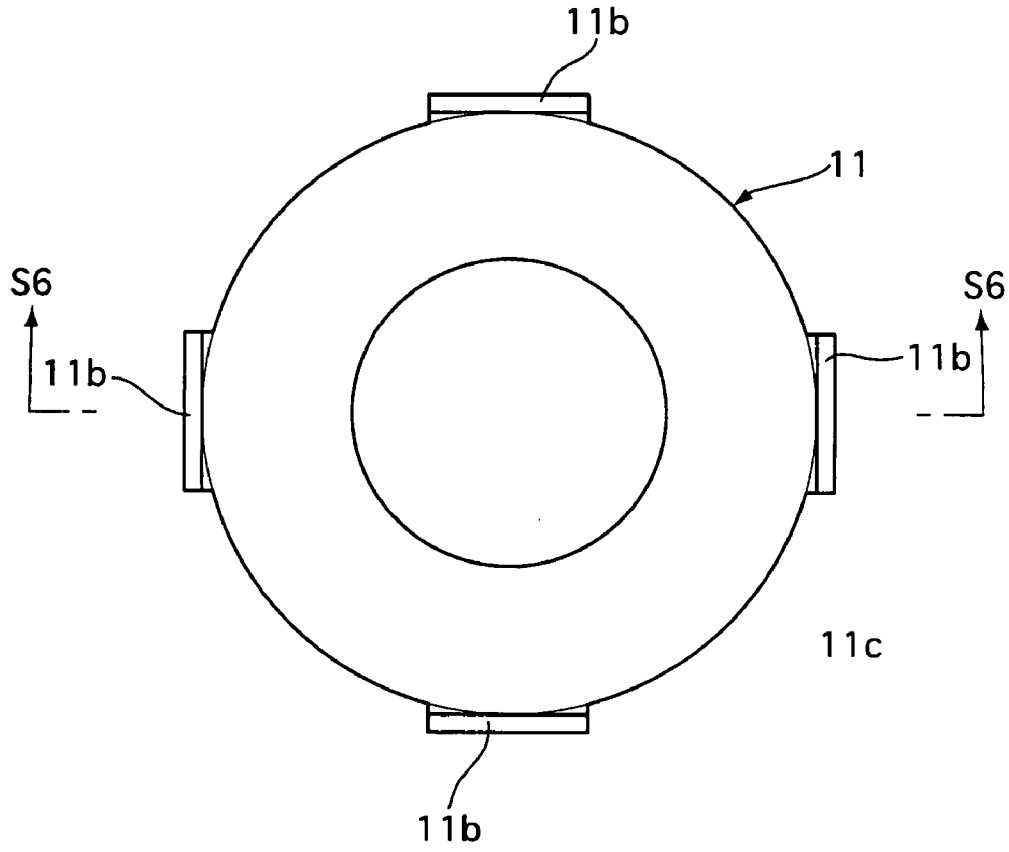
FIG. 5 is an enlarged plan view showing a connecting member used in the oil cooler shown in FIGS. 1 to 3.
Figure 6:
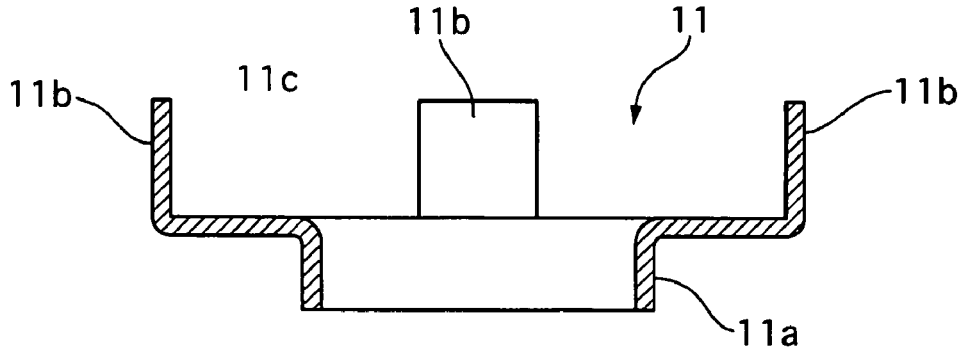
FIG. 6 is a sectional side view of the connecting member taken along a line S6-S6 in FIG. 5.

As shown in FIGS. 5 and 6, the connecting member 11 has an annular portion 11*c*, a cylindrical portion 11*a* projecting from an inner periphery of the annular portion 11*c* in the downward direction, and four projections 11*b* projecting from an outer periphery of the annular portion 11*c* in the upward direction. The cylindrical portion 11*a* can be deflected outwardly by caulking and fixed to an inner root portion of the cylindrical portion 6*a* of the upper shall member 6 of the uppermost element 5*a* as shown in FIG. 3. The projections 11*b* can be deflected to fix a lower annular portion 12*b* of the seat plate 12 with the annular portion 11*c* in a clamping state by inwardly caulking the projections 11*b* as shown in FIG. 3.

As shown in FIG. 2, the seat plate 12 has the lower annular portion 12*b* and an upper annular portion 12*a* smaller in diameter than the lower annular portion 12*b*. The seat plate 12 is contactable with an inner surface of the top wall portion 3 of the lower radiator tank on its upper surface of the upper annular portion 12*a*, and fixed at its inner periphery of the upper annular portion 12*a* by the pipe connector 4 and the top wall portion 3.

Figure 7:
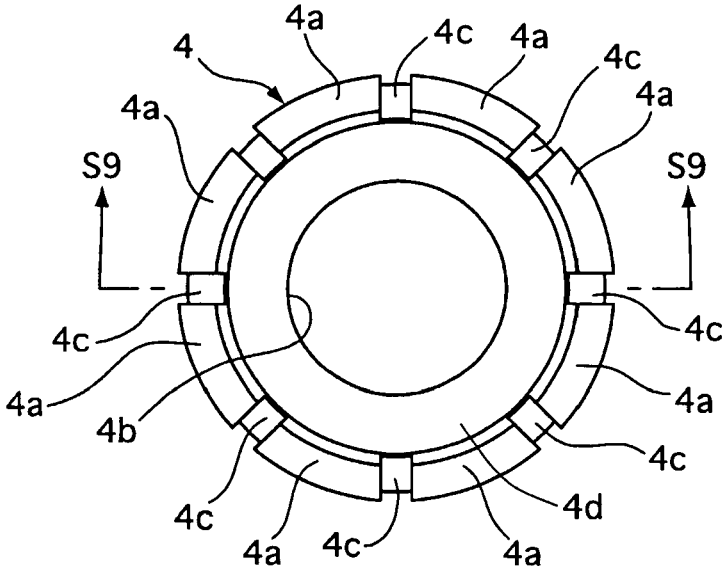
FIG. 7 is an enlarged plan view showing a pipe connecter used in the oil cooler shown in FIGS. 1 to 3.
Figure 8:
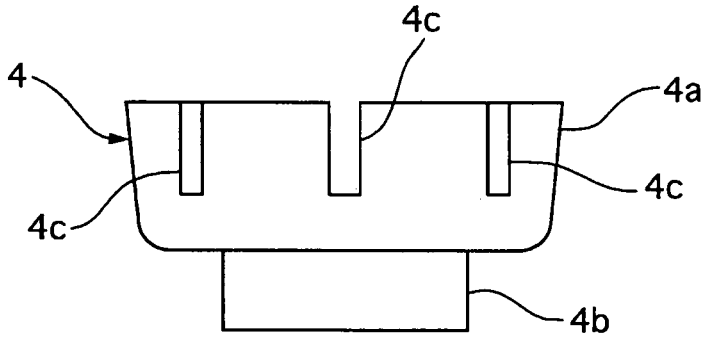
FIG. 8 is a side view of the pipe connecter shown in FIG. 7.
Figure 9:
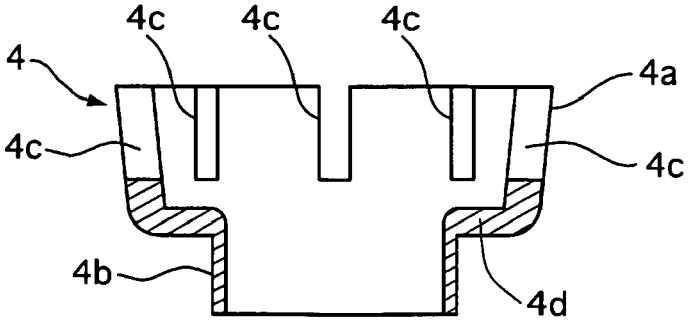
FIG. 9 is a sectional side view of the pipe connector taken along a line S9-S9 in FIG. 7.

As shown in FIGS. 7 to 9, the pipe connector 4 has an annular portion 4*d*, a large-diameter cylindrical portion 4*a* projecting upwardly from an outer periphery of the annular portion 4*d* and having eight vertical notches 4*c*, and a small-diameter cylindrical portion 4*b* projecting downwardly from an inner periphery of the annular portion 4*d*. The large-diameter cylindrical portion 4*a* corresponds to a first retaining portion of the present invention, and the small-diameter cylindrical portion 4*b* corresponds to a second retaining portion of the present invention.

An inner diameter of the large-diameter cylindrical portion 4*a* is set larger than an outer diameter of an enlarged diameter portion 2*a* formed at a lower portion of the connecting pipe 2, so that the large-diameter cylindrical portion 4*a* can partially embrace and fix the enlarged diameter portion 2*a* by inwardly caulking the large-diameter cylindrical portion 4*a*. An outer diameter of the small-diameter cylindrical portion 4*b* is set smaller than a diameter of a through-hole 3*a* of the top wall portion 3 of the lower radiator tank and a hole-diameter of the upper annular portion 12*a* of the seat plate 12 so that the small-diameter cylindrical portion 4*b* and the annular portion 4*d* of the pipe connector 4 can clamp and fix the top wall portion 3 and the upper annular portion 12*a* by outwardly caulking the small-diameter cylindrical portion 4*b*. Incidentally, the annular portion 4*d* is set larger in diameter than the through-hole 3*a* and smaller in thickness than the large-diameter cylindrical portion 4*a* so as to decrease the diameter of the through-hole 3*a* formed on the top wall portion 3 for ensuring its high stiffness.

The large-diameter cylindrical portion 4*a* of the pipe connector 4 corresponds to a first retaining portion of the present invention, and the small-diameter cylindrical portion 4*b* corresponds to a second retaining portion of the present invention.

Figure 10:
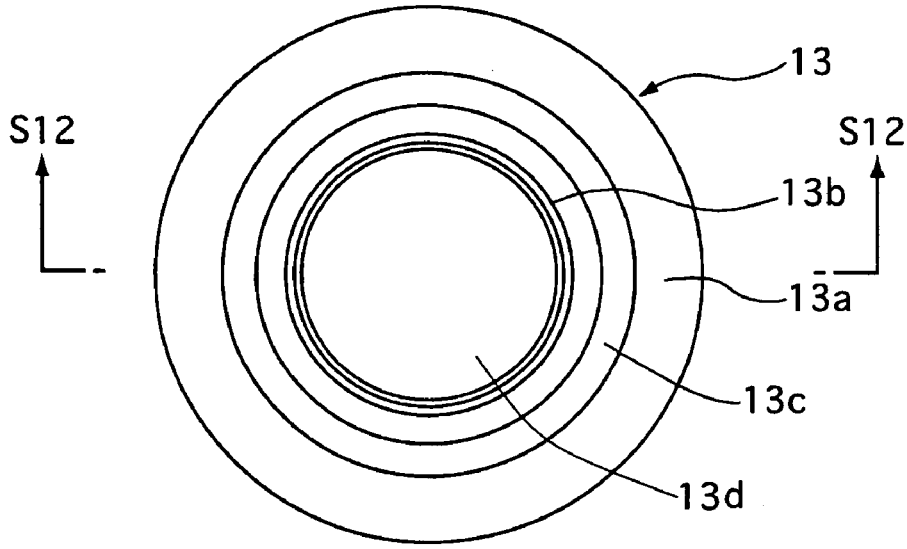
FIG. 10 is an enlarged plan view showing a patch plate used in the oil cooler shown in FIGS. 1 to 3.
Figure 11:
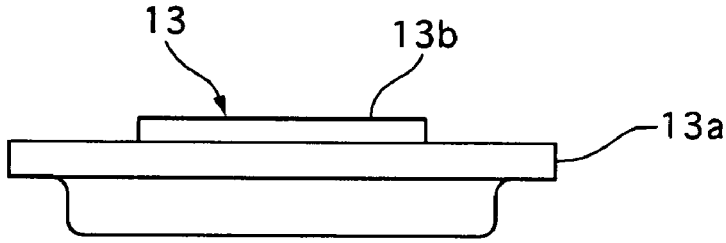
FIG. 11 is a side view of the patch plate shown in FIG. 10.
Figure 12:
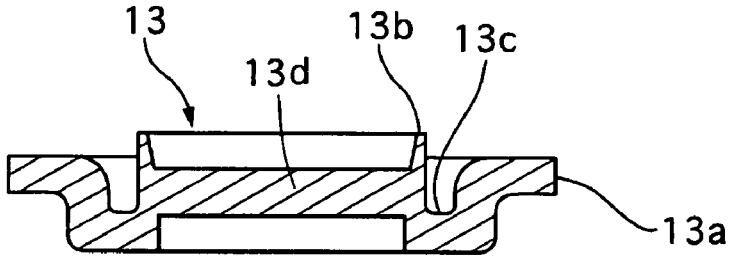
FIG. 12 is a sectional side view of the patch plate shown in FIGS. 10 and 11.

As shown in FIGS. 10 to 12, the patch plate 13 to be fixed to the lowermost element 5*b* has a disc portion 13*d*, a large-diameter annular portion 13*a* projecting outwardly in its radial direction from a lower outer periphery of the disc portion 13*d*, and a small-diameter annular portion 13*b* projecting upwardly from an upper outer periphery of the disc portion 13*d*. An annular groove 13*c* is formed between the large-diameter annular portion 13*a* and the small-diameter annular portion 13*b* so that it can receive the cylindrical portion 7*a* of the lower shell member 7 of the lowermost element 5*b*. The small-diameter annular portion 13*b* is formed as a tapered sectional shape having a height higher than that of the large-diameter annular portion 13*a* and a thickness which becomes smaller with its height.

The large-diameter annular portion 13*a* corresponds to a seat portion of the present invention, and the small-diameter annular portion 13*b* corresponds to a cylindrical portion of the present invention.

All parts of the oil cooler OC of the embodiment and the top wall portion 3 of the lower radiator tank are made of aluminum.

The oil cooler OC is assembled as follows.

First, the oil cooler OC is temporarily assembled. Specifically, as shown in FIG. 2, the elements 5*a*, 5 and 5*b* are obtained by temporally coupling the upper shell member 6 and the lower shell member 7 so that they contain the inner fin 8.

These elements, five elements 5*a*, 5 and 5*b* in this embodiment, and the seat members S1 are alternately piled up with each other to form the heat exchange part 1 of the oil cooler OC.

Figure 13:
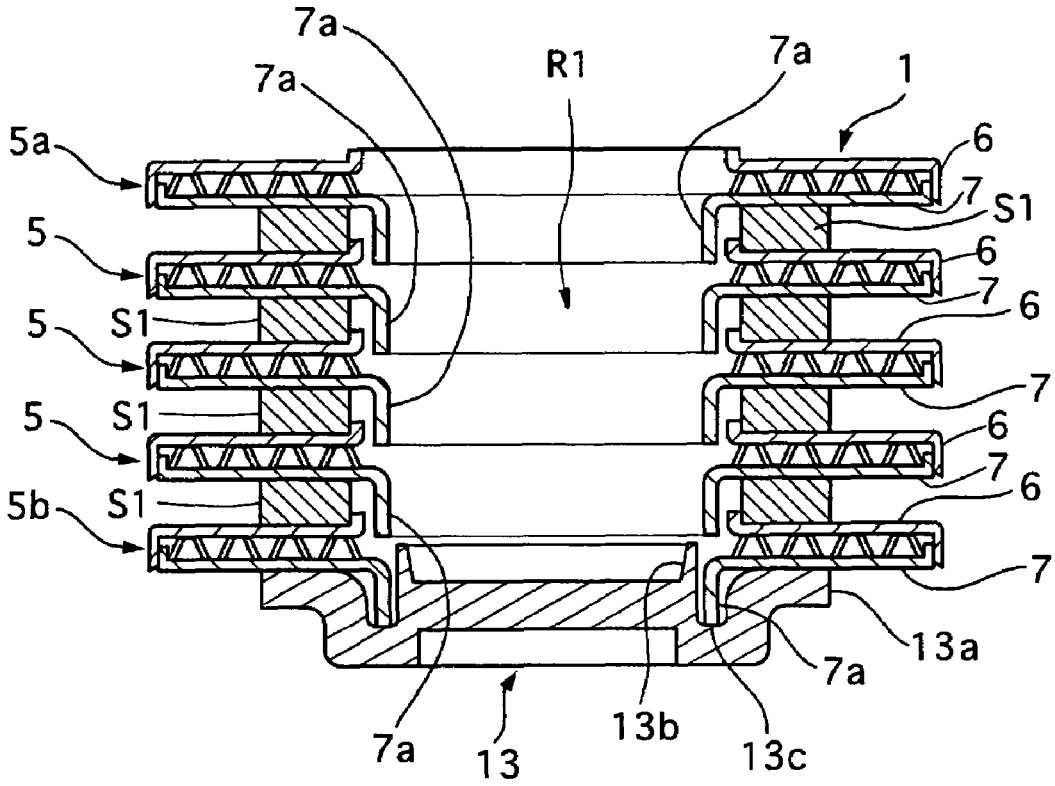
FIG. 13 is a sectional side view of a heat exchange part which is temporarily assembled with the patch plate taken along a line S10-S10 in FIG. 3.

Next, as shown in FIG. 13, the patch plates 13 are located so that their annular grooves 13*c* receive the cylindrical portions 7*a* of the lowermost element 5*b*, respectively, in a state where upper surfaces of the large-diameter portions 13*a* contact with the outer surface of the lower shell member 7 of the lowermost element 5*b*.

Figure 14:
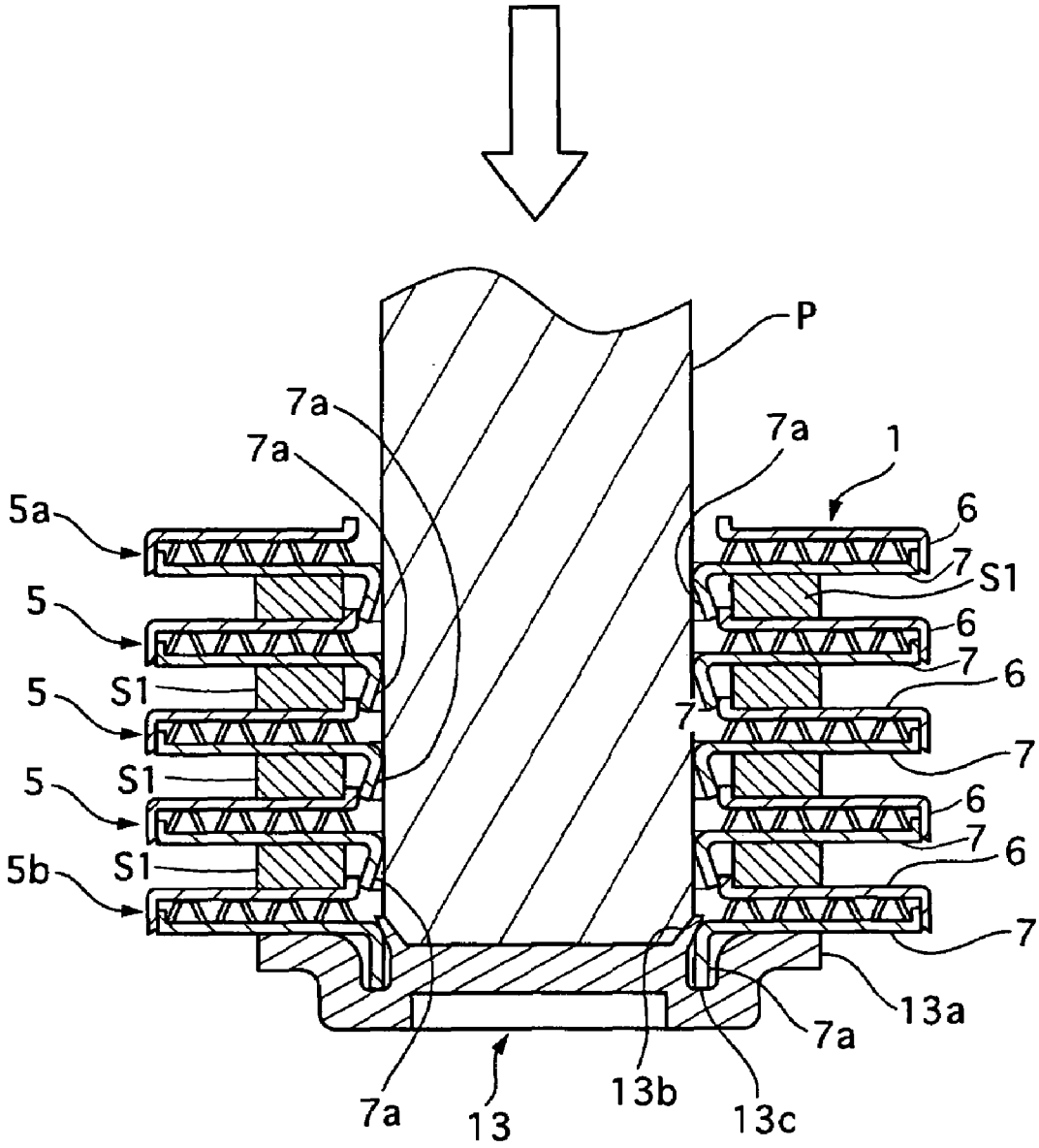
FIG. 14 is a sectional side view illustrating how to fix the elements and the patch plate by caulking in order to form the heat exchanger part.

Then, as shown in FIG. 14, punches P are respectively pressed into the left and right communicating passages R1, although only one of the punch P is shown in FIG. 14, to caulk end portions of the cylindrical portions 7*a* of the lower shell members 7 on the inner periphery of the cylindrical portions 6*a* of the upper shell portions 6 of the lower adjacent elements 5, 5*b*, respectively, to fix the elements 5*a*, 5 and 5*b* with each other. This punching also caulks the small-diameter annular portion 13*b* to the inner periphery of the cylindrical portion 7*a* of the lower shell member 7 of the lowermost element 5*b* so as to clamp the cylindrical portion 7*a* with the large-diameter annular portion 13*a*. After finishing the caulking, the punches P are extracted from the communicating passages R1.

Then, the projections 11*b* of the connecting members 11 are inwardly caulked to clamp the lower annular portion 12*a* of the seat plate 12, and its cylindrical portions 11*a* are outwardly caulked to be fixed to the inner peripheries of the cylindrical portion 6*a* formed on the upper shell portion 6 of the uppermost element 5*a* of the heat exchange part 1.

Figure 15:
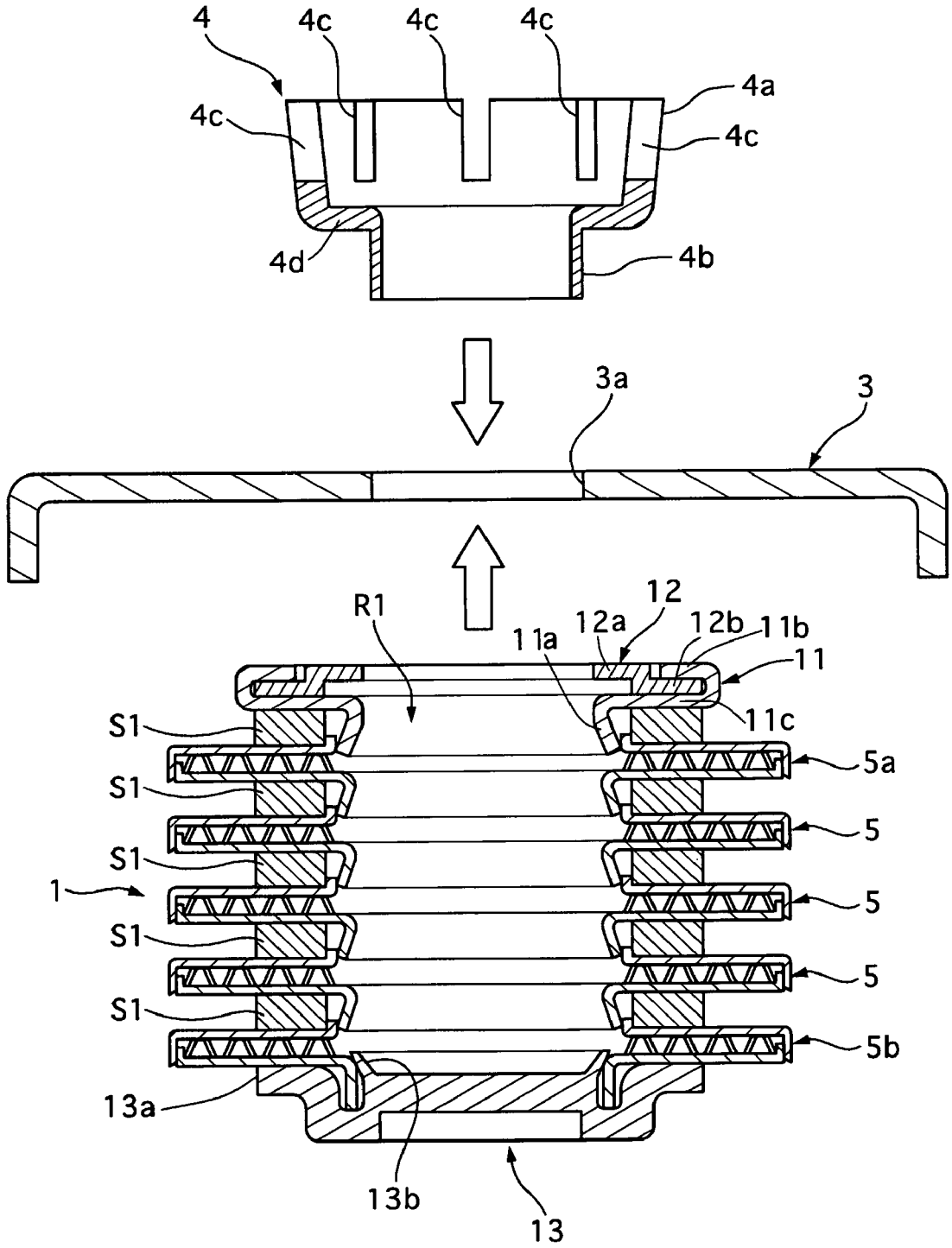
FIG. 15 is a sectional side view of the oil cooler, in a state before the pipe connector and the heat exchange part are temporarily assembled with a top wall portion of a lower radiator tank, taken along the line S10-S10 in FIG. 3.

The heat exchange part 1 including the seat plate 12 is brought, as indicated by a downward large arrow in FIG. 15, to contact to a lower surface of the top wall portion 3 of the lower radiator tank in a state where the communicating passage R1 is in co-axial with the through-hole 3*a* of the top wall portion 3.

Figure 16:
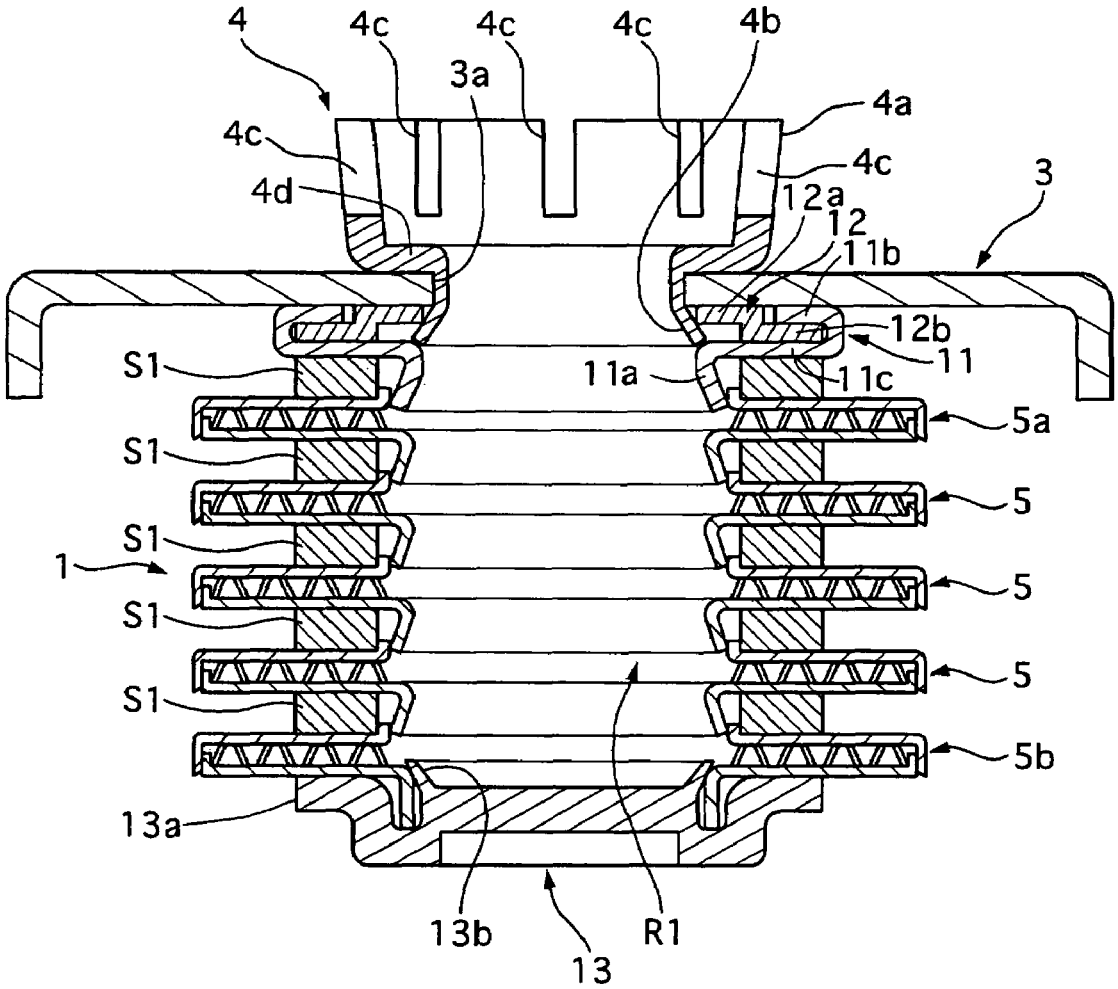
FIG. 16 is a sectional side view of the oil cooler, in a state after the pipe connector and the heat exchange part are temporarily assembled by caulking with the top wall portion of the lower radiator tank, taken along the line S10-S10 in FIG. 3.

On the other hand, the pipe connector 4 is brought, as indicated by an upward large arrow in FIG. 15, to contact to an upper surface of the top wall portion 3, where the small-diameter cylindrical portion 4*b* of the pipe connector 4 is inserted in the through-hole 3*a* of the top wall portion 3 and the communicating passage R1 and caulked on an inner periphery of the seat plate 12 as shown in FIG. 16. In this state, the small-diameter cylindrical portion 4*b* and the annular portion 4*d* clamp the top wall portion 3 and the seat plate 12, fixing the heat exchange part 1, the top wall portion 3 and the pipe connecter 4 with each other.

Figure 17:
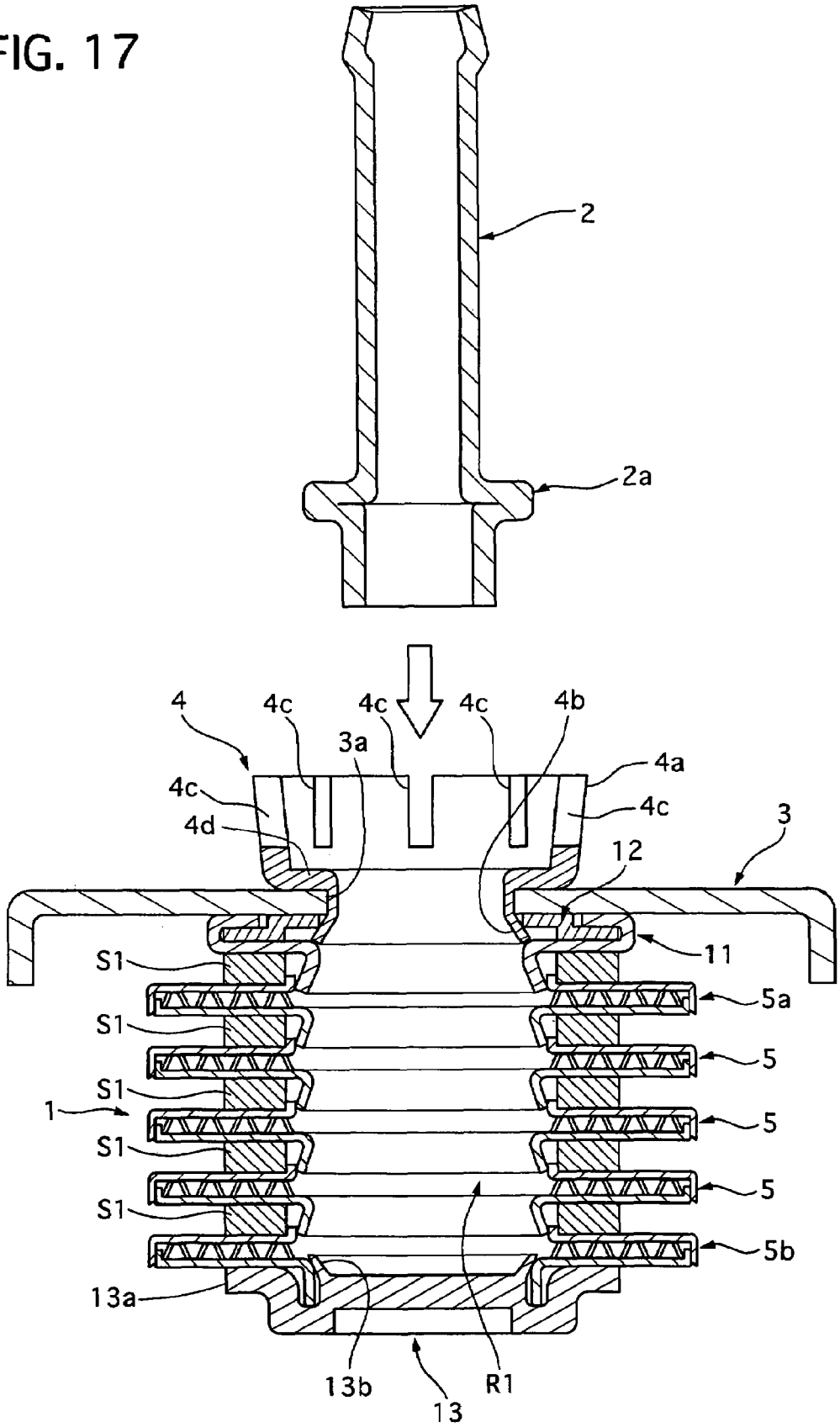
FIG. 17 is a sectional side view of the oil cooler, in a state before a connecting pipe is fixed to the pipe connecter assembled with the top wall portion and the heat exchange part, taken along the line S10-S10 in FIG. 3.
Figure 18:
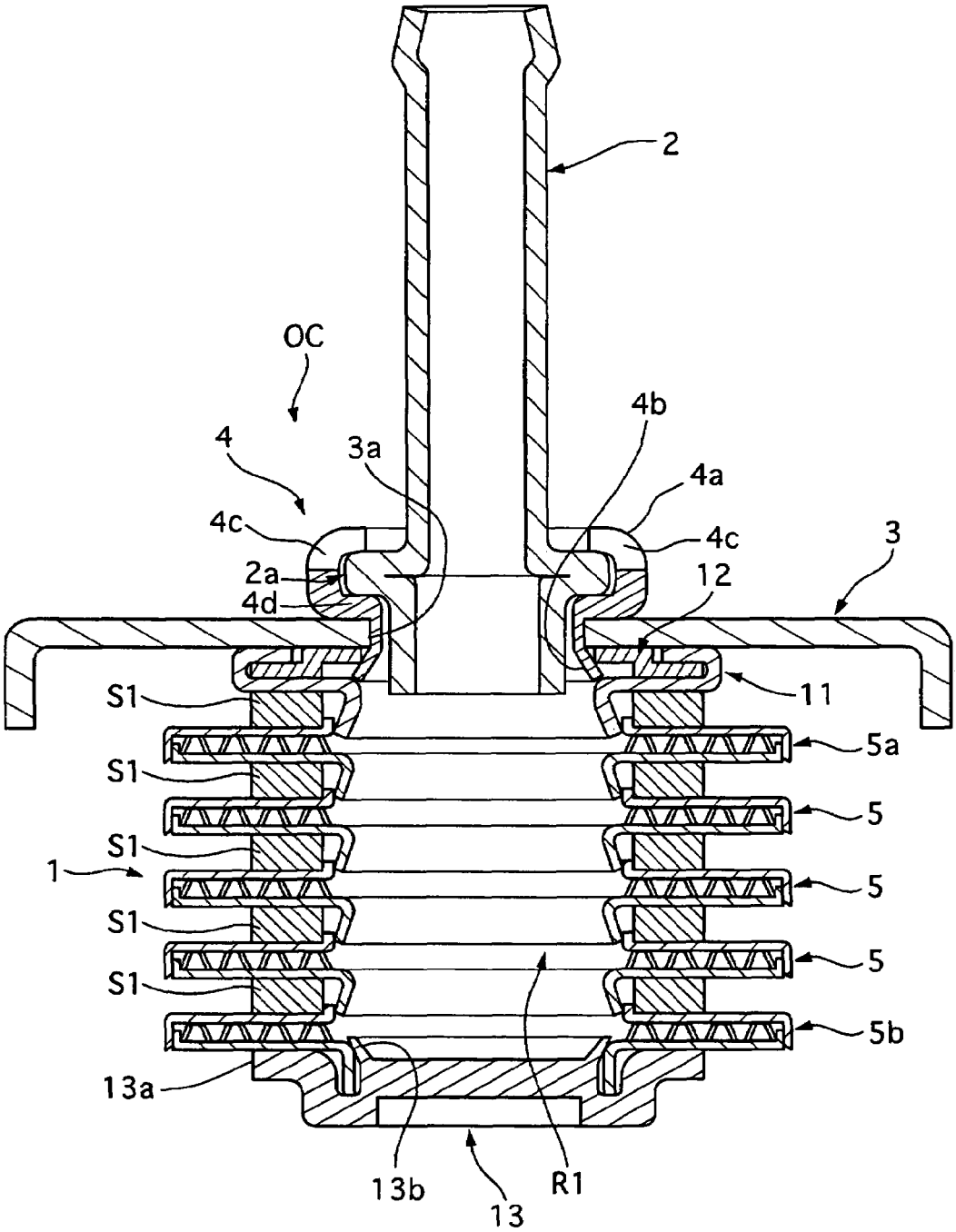
FIG. 18 is a sectional side view of the oil cooler, in a state after the connecting pipe is fixed to the pipe connecter assembled with the top wall portion and the heat exchange part, taken along the line S10-S10 in FIG. 3.

Then, as shown in FIG. 17, the enlarged diameter portion 2*a* of the connecting pipes 2 are brought, as indicated by a downward large arrow, to be inserted into the large-diameter cylindrical portion 4*a* of the pipe connector 4. The large-diameter cylindrical portion 4*a* is caulked inwardly to fix the enlarged diameter portion 2*a* as shown in FIG. 18. The end portions of the large-diameter cylindrical portion 4*a* contact evenly on the enlarged diameter portion 2*a*, since the large-diameter cylindrical portion 4*a* is formed to have notches 4*c*. The end portions of the large-diameter cylindrical portion 4*a* may contact with a part of the enlarged diameter portion 2*a* of the connecting pipe 2 as long as they are fluid-tightly fixed with each other.

In addition, as shown in FIG. 3, there are formed with a gap X1 between the inner surface of the large-diameter cylindrical portion 4*a* and the outer surface of the enlarged diameter portion 2*a*, and a gap X2 between the outer surface of the lower portion of the connecting pipe 2 and inner surface of the small-diameter cylindrical portion 4*b* in a radial direction of the connecting pipe 2. This enables the oil cooler OC of the embodiment to employ connecting pipes having various diameter, 8 mm to 10 mm for example, without an additional member.

Thus-temporarily-assembled oil cooler OC is located into a not-shown heating furnace, where it is heated so that its parts to be connected with each other are joined by brazing. Incidentally, in this brazing, at least one side of contacted portions of the parts may be coated by brazing filler metal after the oil cooler OC is temporarily assembled.

Figure 19:
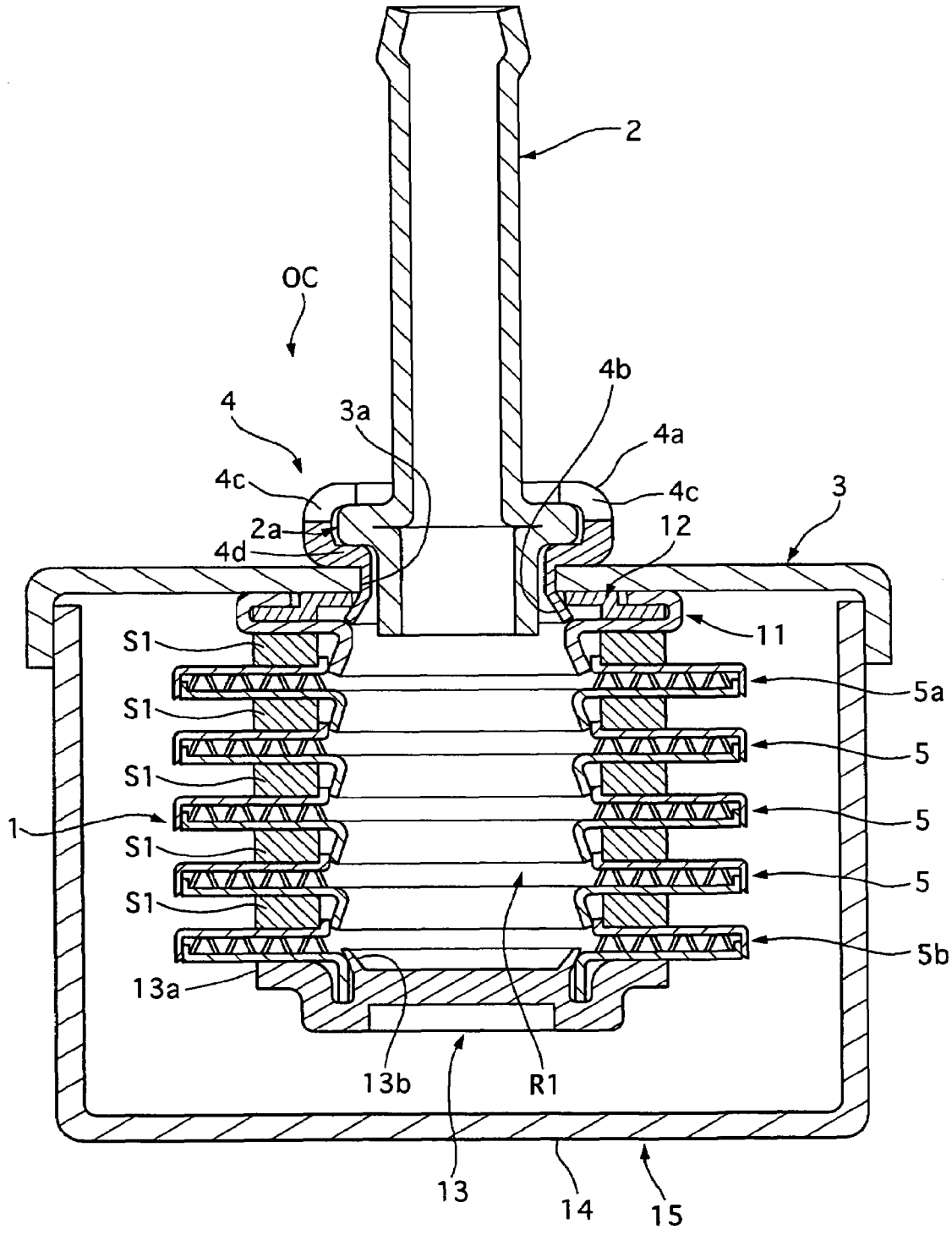
FIG. 19 is a sectional side view of the oil cooler which is contained in the lower radiator tank.
Figure 20:
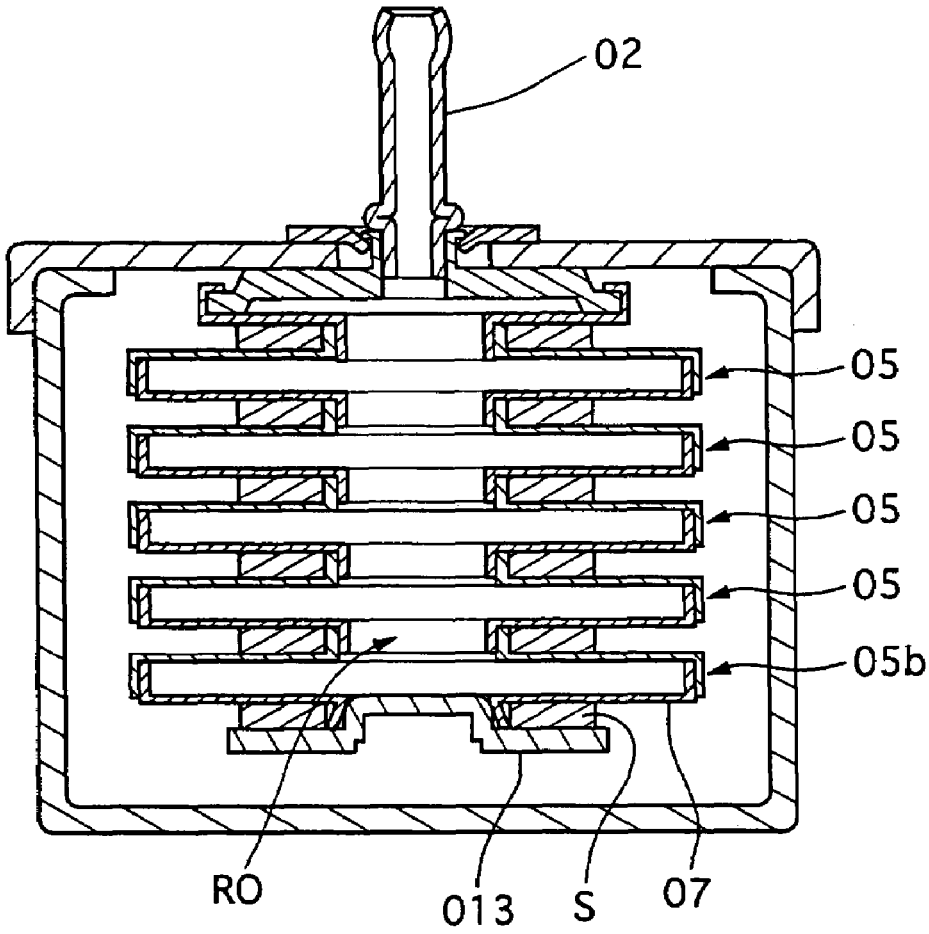
FIG. 20 is a sectional side view showing an example of a conventional oil cooler.
Figure 21:
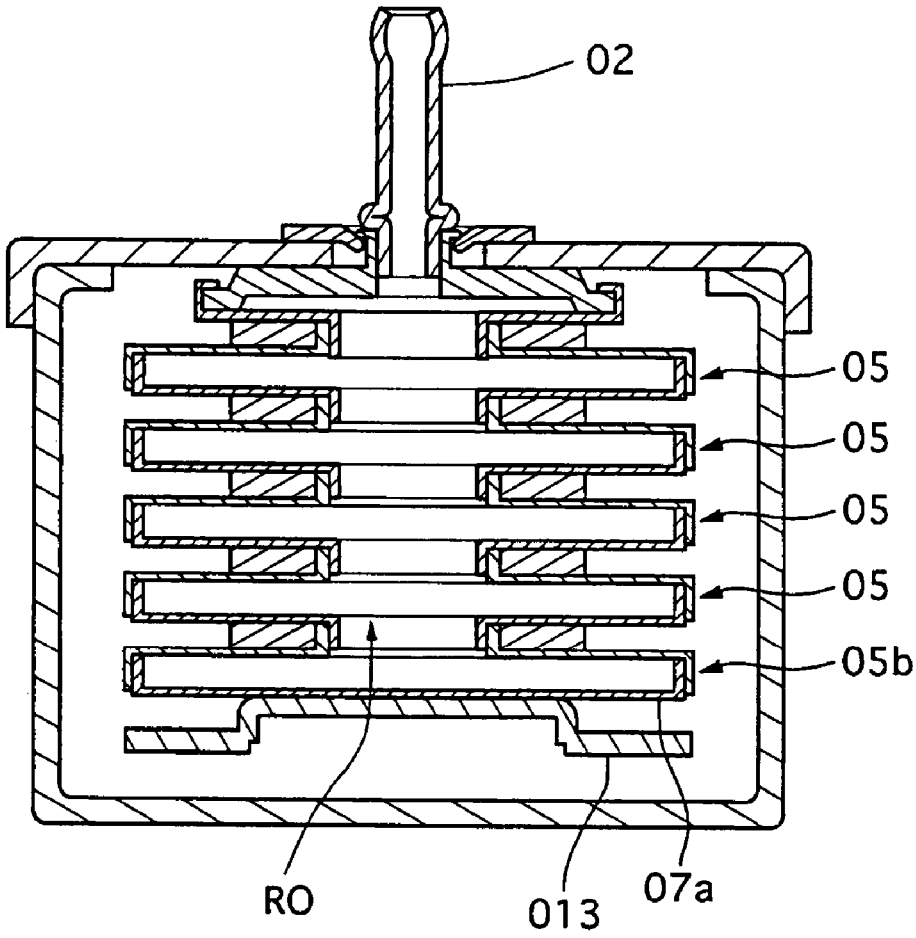
FIG. 21 is a sectional side view showing another example of a conventional oil cooler.

Next, as shown in FIG. 19, the top wall portion 3 with the oil cooler OC is fitted with a boxy wall portion 14 of the lower radiator tank 15 in a state where the oil cooler OC is located in the lower radiator tank 15, and the top wall portion 3 and the boxy wall portion 14 are joined with each other by brazing.

The operation of the oil cooler OC will be described.

The radiator coolant in the radiator flows through tubes of the radiator core to be cooled. Then, the radiator coolant flows through the tubes into the lower radiator tank 15, where it draws heat from the oil in the heat exchange part 1 through the upper and lower shell members 6 and 7 and the inner fin 8 while the oil passes through the elements 5*a*, 5 and 5*b* and the communicating passages R1. The cooled radiator coolant goes to the engine, and the cooled oil goes to the automatic transmission.

The oil cooler OC of the embodiment has the following advantages.

The oil cooler has the connecting pipe 2 with the enlarged diameter portion 2*a* and the pipe connector 4 with the large-diameter cylindrical portion 4*a* and the small diameter cylindrical portion 4*b*, where the large-diameter cylindrical portion 4*a* contains at least a part of the enlarged diameter portion 2*a* and is caulked thereon to fix each other, and the small diameter cylindrical portion 4*b* is caulked on the top wall portion 3 of the lower radiator tank 15 to fix each other. This enables the connecting pipes 2 having different diameters to be easily connected with the heat exchange part 1 of the oil cooler OC and the top wall portion 3 of the lower radiator tank 15 without an additional member. This can decrease its manufacturing process and costs.

The oil cooler OC has the elements 5*a*, 5 and 5*b* with the communicating passages R1 whose bottom portions are closed by the patch plates 13. The elements 5 and 5*b* include the upper shell member 6 and the lower shell member 7 fixed with the upper shell member 7 by caulking. The patch plates 13 are formed with the large-diameter annular portion 13*a* contactable with the outer surface of the lower shell member 7 of the lowermost element 5*b*, the annular groove 13*c* receiving its cylindrical portion 7*a,* and the small-diameter annular portion 13*b* caulked to be fixed to the heat exchange part 1. Therefore, all the elements 5*a,* 5 and 5*b* can be formed in the same shapes, and the patch plate 13 can be easily fixed to the lowermost element 5*b.* This decreases its manufacturing process and costs.

All parts of the oil cooler OC and the top wall portion 3 are made of aluminum, and their temporarily assembly is brazed, thereby eliminating a post-process for fixing the connecting pipe 2 to the heat exchange part 1. This can also decrease its manufacturing process and cost.

The pipe connector 4 has no screw, which can prevent deformation and/or pinching of the seat plate 12.

While there have been particularly shown and described with reference to preferred embodiments thereof, it will be understood that various modifications may be made therein, and it is intended to cover in the appended claims all such modifications as fall within the true spirit and scope of the invention.

The number of the elements may be set arbitrarily according to a demand for coolability of an oil cooler.

The pipe connector 4 and the connecting pipe 2 may be fixed with a seat plate between them, but it is not necessary.

The caulking process of the elements 5*a,* 5 and 5*b* may be separated from that of the patch plates 13 and the lowermost element 5*b,* where a different tool may be used for caulking.

Brazing of the heat exchange part 1, the top wall portion 3 and the connecting pipe 2 and brazing of the top wall portion 3 and the boxy wall portion 14 may be implemented at the same time.

The oil cooler OC may be arranged in any type of radiator as long as it can be cooled by its coolant. For example, although the oil cooler OC is arranged in the lower radiator tank, it may be arranged in an upper radiator tank in a radiator in which the radiator coolant flows through the lower radiator tank toward the upper radiator tank.

The oil cooler OC is not limited for an automatic transmission, and may be used for other device.

The entire contents of Japanese Patent Applications No. 2005-180174 filed Jun. 21, 2005 and No. 2005-180173 filed Jun. 21, 2005 are incorporated herein by reference.

What is claimed is:

1. An oil cooler contained in a radiator tank, the oil cooler comprising:

a connecting pipe having an enlarged diameter portion;

a heat exchange part having a plurality of elements which are piled up and flow oil through interior portions thereof, the elements being formed with a communicating passage for fluidically communicating with the interior portions of the elements; and a pipe connector formed with a first retaining portion that is seated on one side of a wall portion of the radiator tank to contain and fix at least a part of the enlarged diameter portion of the connecting pipe, and a second retaining portion that is inserted through a through-hole of the wall portion and an one end portion of the communicating passage to fix the heat exchange part and the wall portion at the other side of the wall portion, wherein the elements include an upper shell member having a cylindrical portion projecting outwardly and a lower shell member having a cylindrical portion projecting outwardly and having an outer diameter smaller than an inner diameter of the cylindrical portion of the upper shell member, the cylindrical portion of the lower shell member is fixed to the cylindrical portion of the upper shell portion of an adjacent element thereof to form the communicating passage by the cylindrical portions of the upper and lower shell members, wherein the communicating passage is fluidically plugged at the other end portion thereof by a patch plate having a seat portion directly contactable to an outer surface of the lower shell member, a cylindrical portion for fixing the lower shell member of an outermost element, and an annular groove formed between the seat portion and the cylindrical portion to receive the cylindrical portion of the lower shell member of the outermost element, and wherein the cylindrical portion of the lower shell member of the outermost element is clamped by a radially outwardly bent portion of the cylindrical portion and a bottom portion of the annular groove.

2. The oil cooler of claim 1, wherein the cylindrical portion of the patch plate is formed to have a thickness that becomes smaller with a height thereof.

3. The oil cooler of claim 2, wherein the connecting pipe, the heat exchange part, the pipe connector, the patch plate and the wall portion are made of aluminum and fixed with each other by brazing.

4. The oil cooler of claim 3, wherein the first retaining portion is a large-diameter cylindrical portion having notches, and the second retaining portion is a small-diameter cylindrical portion.

5. The oil cooler of claim 4, wherein the small-diameter cylindrical portion is formed smaller in thickness than the large-diameter cylindrical portion.

6. The oil cooler of claim 2, wherein the first retaining portion is a large-diameter cylindrical portion having notches, and the second retaining portion is a small-diameter cylindrical portion.

7. The oil cooler of claim 6, wherein the small-diameter cylindrical portion is formed smaller in thickness than the large-diameter cylindrical portion.

8. The oil cooler of claim 1, wherein the connecting pipe, the heat exchange part, the patch plate and the wall portion are made of aluminum and fixed with each other by brazing.

9. The oil cooler of claim 1, wherein the first retaining portion is a large-diameter cylindrical portion having notches, and the second retaining portion is a small-diameter cylindrical portion.

10. The oil cooler of claim 9, wherein the small-diameter cylindrical portion is formed smaller in thickness than the large-diameter cylindrical portion.

11. An oil cooler contained in a radiator tank, the oil cooler comprising:

a connecting pipe having an enlarged diameter portion;

a heat exchange part having a plurality of elements which are piled up and flow oil through interior portions thereof, the elements being formed with a communicating passage for fluidically communicating with the interior portions of the elements, and the elements including an upper shell member having a cylindrical portion projecting outwardly and a lower shell member having a cylindrical portion projecting outwardly and having an outer diameter smaller than an inner diameter of the cylindrical portion of the upper shell member, the cylindrical portion of the lower shell member is fixed to the cylindrical portion of the upper shell portion of an adjacent element thereof to form the communicating passage by the cylindrical portions of the upper and lower shell members; and a patch plate having a seat portion directly contactable to an outer surface of the lower shell member, a cylindrical portion for fixing the lower shell member of an outermost element, and an annular groove formed between the seat portion and the cylindrical portion to receive the cylindrical portion of the lower shell member of the outermost element so as to fluidically plug an end portion of the communicating passages, wherein the cylindrical portion of the lower shell member of the outermost element is clamped by a radially outwardly bent portion of the cylindrical portion and a bottom portion of the annular groove.

12. The oil cooler of claim 11, wherein the cylindrical portion of the patch plate is formed to have a thickness that becomes smaller with a height thereof.

13. The oil cooler of claim 12, wherein the connecting pipe, the heat exchange part, and the patch plate are made of aluminum and fixed with each other by brazing.

* * * * *